United States Patent [19]

Lyons et al.

[11] 4,311,340

[45] Jan. 19, 1982

[54] URANIUM LEECHING PROCESS AND INSITU MINING

[76] Inventors: William C. Lyons, 1209 Calle Luna, Santa Fe, N. Mex. 87501; Cheryl K. Rofer-DePoorter, 125 San Juan, Los Alamos, N. Mex. 87544; Donald B. Buddecke, Rte. 1, 635A, Rockport, Tex. 78382; Edward A. Zublin, 12800-99 Briar Forest Dr., Houston, Tex. 77077

[21] Appl. No.: 963,825

[22] Filed: Nov. 27, 1978

[51] Int. Cl.[3] ..... E21B 43/28

[52] U.S. Cl. ..... 299/4; 405/57; 405/267

[58] Field of Search ..... 299/4, 5; 405/57, 267

[56] References Cited

U.S. PATENT DOCUMENTS

| | | | |
|---|---|---|---|
| 3,295,328 | 1/1967 | Bishop | 405/57 |
| 3,309,140 | 3/1967 | Gardner et al. | 299/4 |
| 3,309,141 | 3/1967 | Fitch et al. | 299/4 |
| 3,344,607 | 10/1967 | Vignovich | 405/57 |
| 3,407,605 | 10/1968 | Coffer et al. | 405/267 |
| 3,819,231 | 6/1974 | Fehlner | 299/4 |
| 3,823,981 | 7/1964 | Lewis | 299/4 |

*Primary Examiner*—William F. Pate, III
*Attorney, Agent, or Firm*—James E. Snead

[57] ABSTRACT

Mineral values are recovered from underground formations, and pollution of the formation is substantially diminished if not eliminated, by determining the geometry of an ore body and thereafter isolating the body by the formation of an impermeable barrier thereabout which has the capability of retaining leaching fluid therewithin. Leaching fluid remains downhole without substantial dilution by formation fluid, and conversely without pollution of the surrounding formation, until the mineral values are chemically changed into a recoverable substance which is subsequently pumped to the surface of the earth. In one embodiment of the invention, uranium values are recovered by the use of an organic extractant liquid admixed with an acid aqueous leaching fluid by homogenizing the two solutions prior to pumping the mixture downhole into contact with the ore deposit. The homogenized fluid acts on the ore bearing formation to release the uranium ions so that the ions move from the acid aqueous solution into the organic extractant. The organic extractant eventually captures most of the uranium ions, and separates from the spent aqueous solution as the former is forced to the top of the ore body. The concentrated organic extractant accumulates into an underground pool where it can be communicated with a borehole and pumped to the surface of the ground.

15 Claims, 11 Drawing Figures

URANIUM LEECHING PROCESS AND INSITU MINING

BACKGROUND OF THE INVENTION

Insitu metal mining wherein underground ore bodies are leached of their metal values is known to those skilled in the art, as evidenced by the U.S. Pat. Nos. 3,309,141; 3,623,769; 3,841,705; 3,860,289; 3,792,903; 3,115,388; 3,089,750; 3,096,969; 3,360,346; 3,339,979; 3,835,213; 3,836,476; 3,880,980; 2,954,218; 3,823,981; 3,825,649; 2,848,300; 3,488,162; 3,309,140; 3,966,872; 4,007,964; 3,212,239; 3,600,040; 2,850,270; 2,847,275; 2,835,552; 2,860,031; 2,812,233; 2,812,232; and 2,879,646. Often the underground ore body is rubblized by explosives and the like so as to increase the surface area between the leaching fluid and the valuable ore deposit. It is known to recover uranium from uranium bearing ores by leaching with dilute sulphuric acid which brings the uranium into solution as uranium sulphate. Additives, such as sodium chlorate, manganese dioxide, or ferric salt accelerate the leaching process. There are many patents which teach the leaching of uranium from its ore as found in Class 23 of the U.S. Patent Office, of which U.S. Pat. Nos. 2,848,300; 3,488,162; 3,825,649; 3,880,980; 3,836,476; and 3,115,388 are cited for example only.

In many instances, underground leaching and the subsequent production of the mother liquid cannot successfully be carried out because the surrounding underground strata is porous or else contains cracks and fissures; and accordingly, the expensive acid leaching fluid is lost to the surrounding formations. Similarly, existing formation fluid, such as water dilutes the leaching fluid, impairing its effectiveness, or the leaching fluid constitutes a potential pollution to the formation.

Those skilled in the art of borehole forming operations are acquainted with methods by which a borehole can be slanted in any desired direction so as to achieve a borehole which is vertical at the upper end thereof and has a lower end turned horizontally in a given direction. In fact, those skilled in this art can cause the drill bit to make a U-turn, thereby causing the borehole to extend back up to the surface of the earth, should such an expedient be desirable to accomplish.

Those skilled in the art of borehole formation also are aware of the various different techniques to employ in order to pump cementatious material and the like downhole to a specific location so that any desired underlying strata can be hydraulically fractured or "squeezed" with cement. That is, an isolating barrier can be pumped downhole to a specific location and the fluid pumped out into the surrounding strata where it subsequently hardens and forms a barrier through which fluids cannot flow.

There are many uranium ore deposits located 500 to 1,000 feet below the surface of the ground. The criticality of uranium respective to our national defense and civilian energy needs has caused the cost thereof to soar and consequently it has become feasible to employ new techniques in order to retrieve this valuable substance from the earth. The subject of the present invention is a unique process for the recovery of uranium ore which includes employment of the above recited techniques in an unobvious manner, and reduces pollution potential to the natural formation surrounding the ore body.

PRIOR ART

Reference is made to the following Patent Nos:

U.S. Pat. No. 3,309,141,
U.S. Pat. No. 3,860,289,
U.S. Pat. No. 3,089,750,
U.S. Pat. No. 3,339,979,
U.S. Pat. No. 3,880,980,
U.S. Pat. No. 3,825,649,
U.S. Pat. No. 3,309,140,
U.S. Pat. No. 3,212,239,
U.S. Pat. No. 2,847,275,
U.S. Pat. No. 2,812,233
U.S. Pat. No. 3,623,769,
U.S. Pat. No. 3,792,903,
U.S. Pat. No. 3,096,969,
U.S. Pat. No. 3,835,213,
U.S. Pat. No. 2,954,218,
U.S. Pat. No. 2,848,300,
U.S. Pat. No. 3,966,872,
U.S. Pat. No. 3,600,040,
U.S. Pat. No. 2,835,552,
U.S. Pat. No. 2,812,232
U.S. Pat. No. 3,841,705,
U.S. Pat. No. 3,115,388,
U.S. Pat. No. 3,360,346,
U.S. Pat. No. 3,836,476,
U.S. Pat. No. 3,823,981,
U.S. Pat. No. 3,488,162,
U.S. Pat. No. 4,007,964,
U.S. Pat. No. 2,850,270,
U.S. Pat. No. 2,860,031,
U.S. Pat. No. 2,879,646.

SUMMARY OF THE INVENTION

This invention comprehends a process for recovering mineral values from an underground formation without polluting the formation surrounding the ore body, by isolating the ore body to be treated, and thereafter pumping a leaching fluid downhole into intimate contact with the ore body. The ore body is isolated in such a manner that the leaching fluid is captured within the isolated ore body until the mineral values have been leached from the host rock and thereafter the pregnant liquor is recovered by employment of a fluid lifting device.

More specifically, the geometrical configuration and location of the ore body is defined and thereafter boreholes are formed about the outer periphery of the ore body so that a liquid can be subsequently pumped down into surrounding relationship respective to the ore body. The physical properties of the pumped liquid subsequently change to form an impermeable membrane or barrier such that the ore body is isolated therewithin. Leaching fluid is next pumped into intimate contact with the isolated ore body so that the mineral values are leached from the host rock over an interval of time and thereafter the pregnant liquor is pumped to the surface so that the separated mineral values can be subsequently processed.

In one embodiment of the invention, where the ore body has natural impermeable layers below and above, a curtain is formed circumferentially about the entire ore body, thereby preventing radial migration of the leaching fluid which is subsequently pumped downhole, or an influx of fluid from the surrounding formation. The curtain is formed by drilling a plurality of spaced, adjacent boreholes arranged respective to one another such that curtain forming material, such as grout, can be pumped in liquid form down through the borehole where the material from adjacent boreholes communicate with one another, thereby forming a curtain about the entire periphery of the ore body to be isolated.

In another form of the invention, the lower portions of the boreholes below the ore body are slanted substantially radially inwardly toward one another such that each of the plurality of boreholes has an upper vertical length which extends circumferentially about the ore body, and a lower, horizontal length extending towards one another in underlying relationship respective to the bottom of the ore body. When the material which forms the impermeable barrier is pumped down each borehole and caused to communicate with one another, an upwardly opening container, also called a cup or bathtub, is formed which encloses the ore body.

After a bath tub has been formed around an ore body through the use of directional drill holes as stated above, fracturing and grouting, the leaching fluid can be pumped into the ore body via a normal vertical bore hole or other directional holes. Since the ore body is sealed, the leaching fluid can be allowed to stay in the ore body for hours or days to allow chemical leaching of the uranium ion. In other existing in-situ leaching operations, the fluid cannot be allowed to sit since it would be diluted or drain away from the leaching location and it would tend to pollute the surrounding formation. To allow sufficient time for the chemicals (acid or base and the oxidizer) to carry out their action in the ore body is very important. The grout curtain bath tub around the ore body allows the leaching time. After the leaching fluids have done their work, more fluid can be pumped to the ore body displacing the pregnant liquor and allowing the recovery of the pregnant liquor through another bore hole.

In another embodiment of the present invention, the radially spaced boreholes are turned more or less horizontally and radially inwardly at locations both above and below the ore body, thereby completely encapsulating the entire ore body within a cocoon. The cocoon is penetrated to enable leaching chemicals to be placed in intimate contact with the ore therewithin to thereby leach the mineral values from the host material over a long time interval. The pregnant liquor is produced at the end of its residence by pumping it to the surface.

In still another embodiment of this invention, after the ore body has been isolated in accordance with the above embodiments, an aqueous acid leaching solution is homogenized with a solution of an extractant in an organic solvent such as a hydrocarbon. The extractant solution eventually separates from the aqueous acid leaching solution, after the ore has been digested, and flows thereabove where it is forced to the topmost or uppermost position of the isolated ore body. The organic extractant, pregnant with uranium, is pumped to the surface of the ground carrying the uranium ion therewith and leaving the spent leaching fluid within the cocoon.

In another embodiment of the present invention, using directional drilling, drill holes can be made above the ore body from a single vertical drill hole. After these holes have been drilled, hydrofacturing or explosive fracturing of the formation between the drill holes can be carried out.

After the formation has been fractured, grouting can be carried out. This procedure will form an impregnable cap over the ore body. If an organic extractant has been incorporated in the leaching fluid, the organic liquid will eventually separate from the aqueous acid solution and float on the aqueous. If more aqueous liquid is pumped to the ore body, the organic extractant will be washed from the sandstone host rock and forced to the peak of the grout cap formed by the directional drilling and grouting operation. Once the organic extractant is captured in the peak of the grout cap, the grout cap can be penetrated by a drill hole (at the peak) and the organic pregnant liquid removed to the surface.

This procedure should allow an enhanced recovery of uranium from the ore body, (1) since the uranium ion has been captured by the organic extractant immediately after going into solution, and (2) the water flood behind the extractant will wash the formation of the extractant and force it to the recovery hole in the grout cap.

Accordingly, a primary object of the present invention is the provision of a new and improved process for isolating and thereafter recovering mineral values from underground formations, without polluting the surrounding formation.

Another object of the invention is the provision of a drilling and leaching process by which underground ore deposits may be isolated by the provision of an impermeable barrier within which leaching fluids may be contained, thereby enabling the mineral values to be leached from the host material and subsequently recovered.

A further object of the present invention is the provision of a process by which underground ore deposits may be isolated by the formation of a circumferentially extending barrier formed about the periphery thereof within which leaching chemicals may be contained in intimate contact with the ore, thereby enabling the mineral values to be leached from the host rock, and the pregnant liquor pumped to the surface.

A still further object of this invention is the provision of a process by which an upwardly opening container can be formed about an underground formation in such a manner that the container forms an impermeable membrane about the underground formation, thereby enabling leaching chemicals to be contained within the container for an extended length of time.

Another and still further object of the present invention is the provision of a process for recovering mineral values from underground formations, wherein the underground formation is isolated by encapsulating the formation within an impermeable membrane which effectively forms a cocoon thereabout.

An additional object of the present invention is the provision of a process for leaching mineral values from an underground host material wherein an organic extractant solution is homogenized with a leaching solution and pumped downhole into an underground formation containing mineral values, whereupon after the leaching solution has placed the uranium ion in solution, the organic extractant solution separates from the leaching solution, the mineral value is captured by the organic extractant solution, the organic extractant solution migrates upwardly, and the organic extractant solution containing the mineral value is subsequently produced from the underground formation.

These and various other objects and advantages of the invention will become readily apparent to those skilled in the art upon reading the following detailed description and claims and by referring to the accompanying drawings.

The above objects are attained in accordance with the present invention by the provision of a method of recovering mineral values from underground formations for use with appartus fabricated in a manner substantially as described in the above abstract and summary.

DETAILED DESCRIPTION OF THE PREFERRED EMBODIMENTS

Throughout the various figures of the drawings, wherever it is possible or logical to do so, like or similar numerals will refer to like or similar elements.

Figure 1:
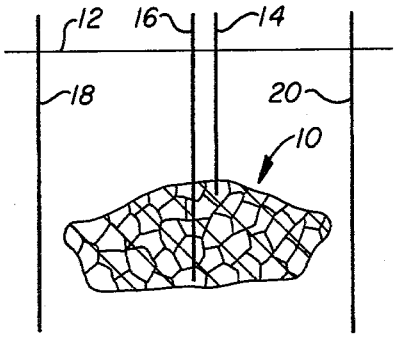
FIG. 1 is a schematical representation of a cross-section of the earth's structure disclosing an underground formation.

In FIG. 1 there is disclosed a hypothetical representation of a cross section of the upper strata of the earth having an underlying formation 10 which contains valuable mineral values. In the illustrative embodiments set forth herein, the valuable minerals 10 will be referred to as "uranium ore," that is, a subsurface body or stratum, called the host material, within which uranium in one form or another is contained. The uranium generally will be in a form that can be chemically treated by various known leaching processes.

The ore body 10 usually is located several hundred feet below the surface 12 of the ground. A borehole 14, preferably cased at the upper end thereof, extends into proximity of the upper central part of the ore body. Another borehole 16 optionally extends downhole to the bottom of the ore body.

Figure 3:
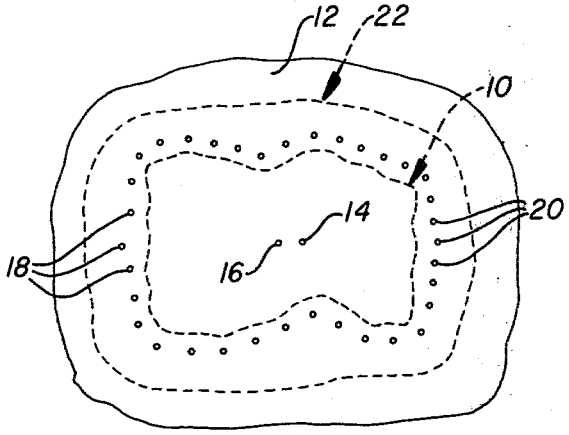
FIG. 3 is a cross-sectional view taken along line 3—3 of FIG. 1.

Radially spaced-apart boreholes 18 and 20, identical in construction to the boreholes 14 and 16, extend about the outer periphery of the ore body 10 as best seen illustrated in FIG. 3.

More specifically, the boreholes 18 and 20 are placed on predetermined centers, such as fifteen foot centers, and are not necessarily located in equally spaced relationship to the ore body 10. That is, sometimes one or more of the boreholes may penetrate the valuable ore body because of the irregular configuration thereof, or for other reasons which should become apparent as the remainder of this disclosure is more fully digested.

Figure 2:
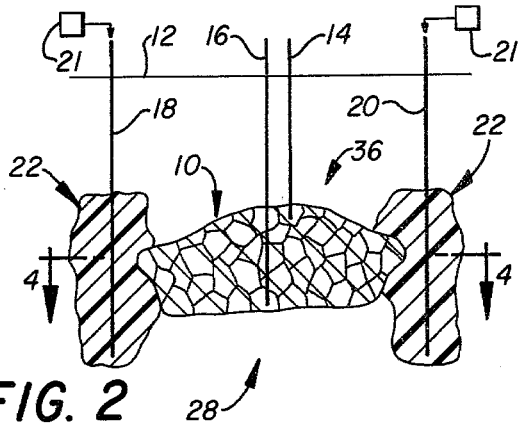
FIG. 2 is a cross-sectional, schematical representation of the underground formation seen in FIG. 1, with the process of the present invention being disclosed in conjunction therewith.
Figure 4:
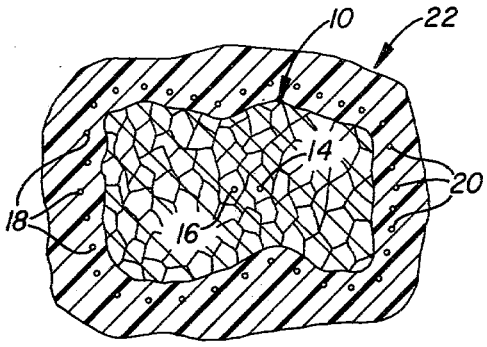
FIG. 4 is a cross-sectional view taken along line 4—4 of FIG. 2.

As seen illustrated in FIGS. 2 and 4, in conjunction with FIGS. 1 and 3, curtain forming material at 21 is pumped down the radially arranged boreholes 18 and 20 until a barrier or curtain in the form of the illustrated curtain 22 completely surrounds the irregular ore body.

The specific details by which adjacent boreholes 18 and 20 are communicated by the pumping of the curtain forming material is achieved by employment of various different expedients which will be more fully discussed later on in this disclosure.

Figure 5:
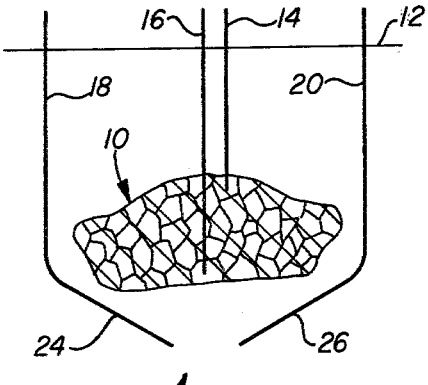
FIGS. 5 and 6 are cross-sectional representations of the earth wherein a process in accordance with the present invention is being carried out.
Figure 6:
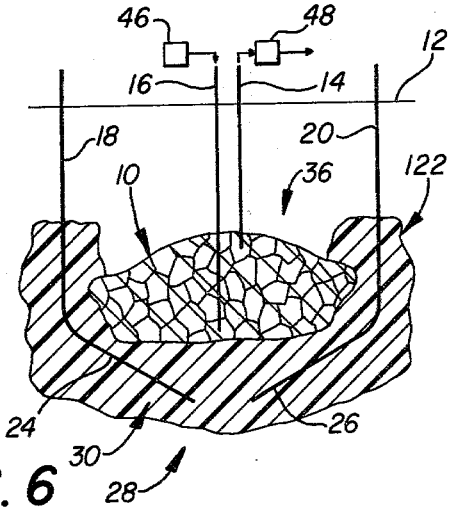

In FIGS. 5 and 6, the boreholes 18 and 20 have been turned radially inward towards one another by the employment of the drilling techniques suggested in the Zublin U.S. Pat. Nos. 2,336,333; 2,344,277; 2,500,267; 2,621,894; 2,631,820; 2,634,097. Other techniques for forming slanting boreholes may also be employed while remaining within the comprehension of this invention.

In the embodiment of FIGS. 5 and 6, the impervious barrier 122 is in the form of a cup or bathtub which prevents outward or downward migration of liquid at 28 by the provision of a cup or bathtub 30 so that the cup upwardly opens towards the surface as generally indicated by the numeral 36.

Figure 7:
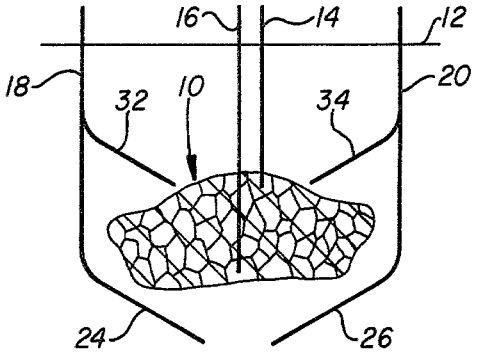
FIGS. 7 and 8 are cross-sectional representations of the earth which discloses still another embodiment of the present invention.
Figure 8:
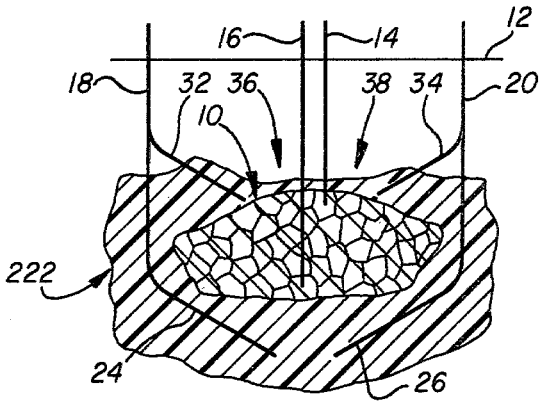

In the embodiment set forth in FIGS. 7 and 8, each of the radially spaced boreholes 18 and 20 are further provided with radially, inwardly directed, slanted boreholes 32 and 34 respectfully through which barrier-forming material can be pumped such that the ore body 10 is provided with a top or roof 38, thereby completely encapsulating the ore body with an impermeable membrane 222, herein referred to as a cocoon.

Figure 9:
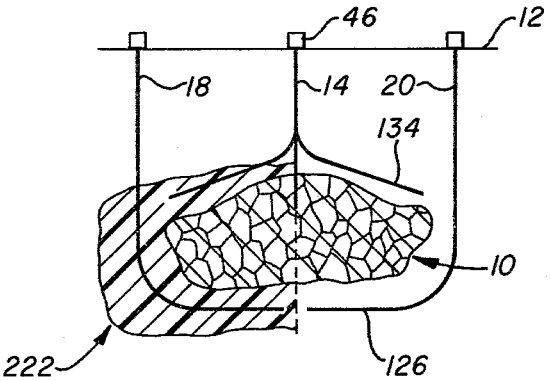
FIGS. 9 and 10 are cross-sectional representations of the earth wherein still another embodiment of the present invention is being carried out; and, FIG. 11 sets forth a cross-sectional representation of a substratum of the earth wherein a process in accordance with the present invention is being carried out.
Figure 10:
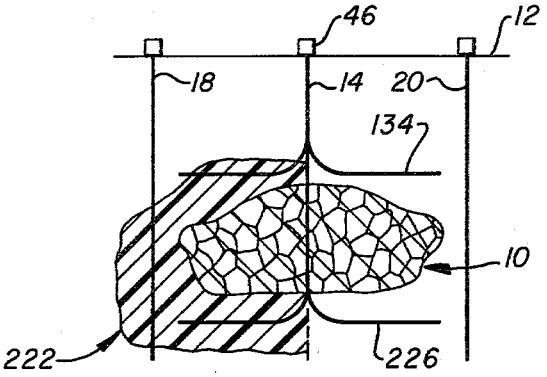

In FIGS. 9 and 10, the ore body is provided with a circumferentially extending curtain as well as a floor and a top by utilizing the radially spaced boreholes 18 and 20 in order to form the sides and bottom, while utilizing either or both of the centrally located boreholes 14 and 16 in order to form the radiating, slanted boreholes 134 which radiate from the common borehole 14 towards the outer periphery of the ore body.

Barrier-forming material pumped down through borehole 14 and along the plurality of radiating, slanted passageways 34 or 134 provide the roof of the cocoon, thereby completely encapsulating the ore body 10 within an impermeable membrane.

In FIG. 10, the periphery of the ore body has been isolated by a curtain formed in the before discussed manner, while both the roof and the floor is formed from a common borehole 14 by employment of the radiating, slanted holes 134 and 226.

It is within the contemplation of this invention that the method may be employed in situations where nothing more than a cap over the ore bearing formation is needed. Such situations would include formations surrounding the ore bearing formations that are naturally inpermeable, and the use of an organic extractor liquid with the acid (or basic) aqueous leaching liquid. The organic extractor would eventually capture nearly all of the uranium ions, and the organic extractor being lighter than the aqueous solution would eventually separate from the aqueous and be forced to the top of the ore body, and be concentrated much like a natural petroleum pool in an underground reservoir. Once the organic extractor has so concentrated it should be easy to extract the organic fluid to the surface via boreholes to the ore body in much the same way natural petroleum is recovered.

Numeral 46 schematically indicates pumping means by which leaching chemicals can be pumped down into the isolated borehole, while numeral 48 schematically indicates pumping means or lifting means by which the pregnant liquor can be retrieved.

Figure 11:
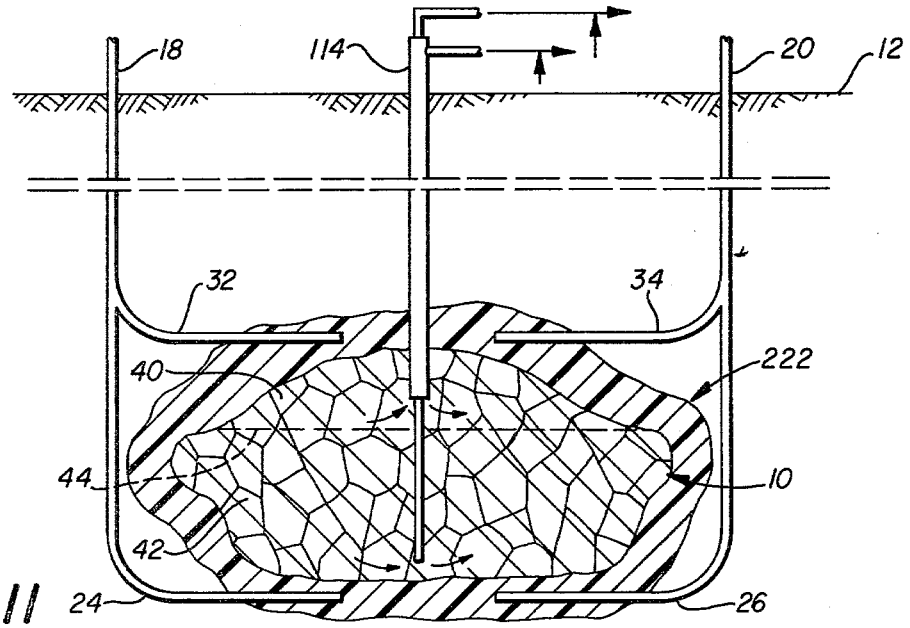

In FIG. 11, the isolated ore body 10 is encapsulated within a cocoon 222 of impervious material, as for example, cementatious material known to those in the oil and mining industry as, for example, Portland Cement, special gels admixed with drilling cement, plastic materials such as epoxy resin, rubber in liquid or semi-liquid form, and other liquid or semi-liquid materials which form a barrier against the outflow of leaching chemicals or inflow of formation fluids.

As used throughout this disclosure, the term "leaching fluid" is intended to mean a liquid which can be pumped downhole into intimate contact with the mineral values contained within the host rock or ore body 10 and which causes the mineral values to be placed into solution, thereby enabling the subsequent recovery of the mineral values.

Leaching fluids are exemplified by the following: sulfuric acid, nitric acid.

Organic extractants are exemplified by the following: Tri-n-butyl phosphate, n-hexone.

In operation of the embodiment disclosed in FIGS. 1–4, the ore body 10 is geologically defined, thereby enabling the geometrical configuration and precise location thereof to be known in order to enable the subsequent isolating techniques of this invention to be practiced. Boreholes 18 and 20 are formed about the periphery of the ore body 10 to be isolated. Should the ore body 10 be extensive, it will sometimes be necessary to form the boreholes 18 and 20 through the part of the ore body 10.

In order to pump barrier-forming material downhole in such a manner that a circumferentially extending curtain 22 is formed about the entire ore body, it may be necessary to fracture the material between adjacent boreholes 18 and 20. In some formations, this can be achieved by drilling the boreholes 18 and 20 at spaced intervals of 15 feet or so and thereafter applying fracturing pressure at 21 by the employment of enormous pumps which develop sufficient pressure whereby the pressure drop or the force placed upon the downhole formation causes cracks and passageways to occur therebetween. This can be accomplished by pumping the curtain-forming material under tremendous pressure, or alternatively, by first fracturing the surrounding zone and subsequently pumping the curtain-forming material downhole.

In some instances explosives are placed downhole in proximity of the ore body in order to rubblize the formation adjacent to the ore body with subsequent pumping of the curtain-forming material forming the isolating curtain.

Those skilled in the art of hydrofracturing and the rubblizing or underground formations, having read this disclosure, will be able to employ various different flow patterns respective to various different ones of the boreholes 18 and 20 in order to achieve control over the direction of the flow respective to the formation of the curtain 22. In other words, it may be advantageous to flow curtain-forming material through selected ones of the boreholes 18 and 20 while leaving selective ones of the boreholes at reduced pressure.

After the curtain 22 has been formed, leaching chemicals are flowed downhole at 14 and the pregnant liquor is recovered at a subsequent time through a borehole 16 which extends to the lowermost part of the ore body. Boreholes 14 and 16 may be the same passageway or alternatively, can be an old passageway resulting from the original geology of the area.

After the deposited barrier-forming material has set a sufficient length of time to harden into a continuous, impervious mass, the leaching chemical is pumped into the ore body and left downhole until tests indicate that the uranium values have been leached from the ore.

The grout curtain of FIGS. 1–4 is employed where the underlying strata at 28 is impervious to the flow of aqueous acid solution, thereby eliminating the need for the formation of the bathtub seen at 122 in FIG. 6. On the other hand, where the underlying strata at 28 is already fractured or the permeability thereof demands a fluid barrier, the techniques exemplified by FIGS. 5 and 6 must be employed to preclude loss of the leached uranium values, or pollution of the underlying formation.

In the embodiments set forth in FIGS. 5 and 6, the radially spaced-apart boreholes 18 and 20 are turned radially inwardly at 24 and 26, thereby drilling a slanted borehole in underlying relationship respective to the ore body 10. The boreholes can be slanted respective to the horizontal as illustrated in the figures of the drawings as may be required, depending upon the actual configuration of the bottom of the ore body. The area immediately adjacent to the ore body is fractured and barrier-forming material pumped thereinto in the manner of FIGS. 5 and 6, thereby forming the illustrated, upwardly opening cup 122. The cup 122 is employed in instances wherein leaching chemicals are otherwise lost downwardly at 28; and accordingly, the embodiment of FIG. 6 eliminates gravitation of leaching fluid as well as contamination of the chemical treated ore body from extraneous, upwardly moving fluids.

The formation of the cup 122 forms a container which isolates the ore body from the surrounding strata; and accordingly, treatment thereof can be carried out in a manner heretofore unknown to those skilled in the art because substantially no loss of chemical is suffered, thereby enabling the treatment to be extended over significant lengths of time.

After the leaching fluid has placed the uranium ore into solution, production techniques can be employed to pump the pregnant liquor to the surface of the earth, thereby enabling the uranium values to be extracted from the underground ore deposits in accordance with the objects of this invention.

In the embodiment FIGS. 7 and 8, a roof or cap 38 is formed at the upwardly opening cup, thereby providing a cocoon 222 which completely encapsulates the ore body 10. The cocoon is formed by drilling radially inwardly from the existing boreholes 18 and 20 at a location above and below the ore body. In some instances, all of the radially directed passageways may be formed in accordance with FIGS. 9 and 10 by utilizing a common, centrally located borehole 14 for formation of the passageways 134 or 226. In this respect, it is possible to utilize offset drilling techniques about the periphery of the borehole in order to reduce the drilling to a minimum. This is especially of significance where the ore deposits are located at great depths below the surface of the earth.

The employment of a cocoon 222 which completely encapsulates the entire ore body is required where high concentrations of uranium is present, and where expensive leaching and extracting chemicals are employed. Furthermore, in instances where the capillary action of the surrounding strata contributes to the loss of leaching chemical, it is advantageous to employ the cocoon technique in lieu of just the bathtub or curtain process. In other situations, particularly where an organic extractant is used, it may be necessary to use only a cap over the ore body. In those cases the methods disclosed in FIGS. 7–10 can be used by eliminating the curtain or bottom enclosing features.

In another embodiment of this invention, the ore body 10 is isolated by employing the techniques set forth in either of the above embodiments of the invention so as to prevent egress of treatment fluid therefrom. Sometimes this can be achieved by employment of a curtain 22 where the underlying strata 28 and the overlying strata 36 prevents outward migration of the treatment fluid. Sometimes the entire ore body must be completely encapsulated in the manner of FIGS. 7, 8, 9, and 10, thereby providing the isolated ore body schematically disclosed in FIG. 11.

In the process as shown in FIG. 11, an organic extractant, such as tri-n-butyl phosphate dissolved in a solvent such as clean, odorless kerosene, is homogenized with an aqueous acid (or basic) solution, such as five percent sulfuric acid, with the homogenization occurring, for example, by the application of ultrasound and the entire vessel within which the ore body is contained is filled with this treatment fluid.

The uranium ion is captured by the organic extractant solution immediately after going into solution, and after a sufficiently long time the organic extractant solution migrates upwardly as the aqueous acid solution displaces in a downward direction. Ultimately, the organic extractant solution containing the uranium ions is located at the uppermost part 40 of the ore body 10 while the spent aqueous acid solution is located in underlying relationship as indicated by numeral 42. Often the nature of the ore body will not provide a definite interface 44, and in such instances, a water flood can be utilized by pumping water or the like down borehole 16 to the bottom of the ore body to wash the formation of leach and extractant and force the extractant to the recovery hole formed through the top of the cocoon as indicated by numeral 14, for example.

The aqueous acid leaching fluid used herein can be either nitric or sulfuric acid as well as other known leaching fluids. The grouts may be selected from any substances which can be translocated from the surface of the earth down through the boreholes, where the material subsequently forms the above mentioned impermeable barrier, and includes cement grouts such as sand-cement mixture, fly-ash cement, and the like. Clay grouts, such as Bentonite suspension; and silica grouts such as silicate-bicarbonate or silicate-aluminate may be used to advantage. In extreme cases where the uranium concentration is very high, the organic polymers, such as epoxy resins, polyester resins, and chrome-lignin may be employed.

EXAMPLE 1

A mountainous region in New Mexico was geologically investigated and it was determined that an ore body containing seven tenths of one percent (0.7%) of $U_3O_8$ or ore in a host rock of sandstone was located six hundred feet below the surface of the ground. The host rock or stratum containing the ore was found to be thirty feet thick and two hundred feet in mean diameter.

A cup was formed in accordance with FIGS. 5 and 6 by drilling boreholes 18 and 20 along fifteen foot centers. The surrounding substructure, along with the ore body, was relatively permeable so that sufficient pressure was usual during the grouting procedure to communicate the boreholes with one another and to avoid fracturing the formation. Sufficient barrles of Portland cement were pumped downhole under pressure through the vertical and lateral upper and lower borehole portions 18 and 24 by choosing alternate ones of the boreholes while leaving the remaining boreholes open for test purposes in order to assure that the curtain-forming material communicated circumferentially about the borehole.

The system was left dormant for two weeks and thereafter five percent sulfuric acid was pumped through a borehole 16 until evidence from test hole 14 indicated that the dilute aqueous acid solution completely filled the ore body.

The system was left dormant for seven months and thereafter produced from borehole 16.

EXAMPLE 2

In another region, a smaller ore body containing very high concentrations of uranium was discovered at 450 feet below the surface. Boreholes were formed in accordance with FIGS. 5 and 6, and hydraulic fracturing subsequently performed, using brine. A silica grout was selected for the curtain-forming material because the nature of the existing formation fluid was not condusive to the use of cement grout. The grout displaced the brine, and thereafter, a leaching fluid comprised of a 5% sodium bicarbonate base solution acid was pumped through borehole 16 until the ore body was considered saturated. The system was left dormant for 200 days, and when tests indicated that the leaching process was completed, the pregnate liquor was recovered.

EXAMPLE 3

A uranium ore body was defined in a sand stone hot formation containing seven tenths of one percent (0.7%) of ore, or $U_3O_8$. There was no problem with either migrating the leach fluid into the surrounding host formation, or dilution of the leach fluid by existing formation fluid.

The formation was fractured, and a cap was formed over the ore bearing formation in the manner described in connection with FIGS. 7–10. An organic extractant, tri-n-butyl phosphate was dissolved in a solvent, consisting of clean, odorless kerosene and homogenized with a five percent (5%) solution of sulfuric acid. The organic extractant and leaching fluid solution was pumped into the ore bearing formations and left until the organic extractant with uranium ions captured began to appear at a test hole inserted into the top of the formation through the cap. Additional aqueous liquid, such as brine was then pumped into the ore body and the organic extractant was removed from the peak of the grout cap.

I claim:

1. Method for recovering metal values by insitu leaching of an ore body located below the surface of the earth, comprising the steps of:

(1) forming an upwardly opening impervious barrier within which the ore body is contained by drilling a plurality of boreholes about the periphery of the ore body to be leached, wherein the boreholes extend from the surface of the earth, downhole beside the ore body, and then turn laterally and continue across the bottom of the ore body;

(2) pumping a barrier-forming substance downhole through said boreholes in sufficient quantity to form a continuous wall which extends circumferentially about and under the ore body; wherein said barrier-forming substance has the property of being a liquid when pumped downhole and where thereafter said barrier-forming substance forms an impermeable barrier;

(3) flowing leaching fluid downhole into intimate contact with said ore body where said leaching fluid is contained in intimate contact with said ore body by said barrier;

(4) recovering the pregnant leaching fluid after the mineral values have been gained from the ore by driving the pregnant leaching fluid towards the surface of the ore body with a water drive where the pregnant leaching fluid is produced.

2. The process according to claim 1 wherein the formation from which the mineral values are to be recovered is completely encapsulated with the barrier-forming substance according to the following steps:

drilling laterally directed boreholes at a location above said isolated formation, and thereafter pumping said barrier-forming substance downhole into said laterally directed boreholes;

and applying sufficient pressure to said pumped barrier-forming substance to cause the substance to communicate the boreholes and thus completely encapsulate said formation.

3. The method of claim 1 wherein said barrier-forming substance is selected from the following materials:

1. Cement Grouts including Sand-cement, flyash-cement, and the like;
2. Clay Grouts such as Bentonite suspension and the like;
3. Silica Grouts such as Silicate-bicarbonate, silicate-auminate, and the like;
4. Organic Polymers such as Eposy Resin, Polyester Resin, Chrome-lignin, and the like.

4. The method of claim 1 wherein said leaching fluid is selected from the following:

Nitric acid and
Sulfuric acid.

5. The method of claim 1 wherein said barrier-forming substance is selected from the following materials:

1. Cement Grouts including Sand-cement, flyash-cement, and the like;
2. Clay Grouts such as Bentonite suspension and the like;
3. Silica Grouts such as Silicate-bicarbonate, silicate-aluminate, and the like;
4. Organic Polymers such as Epoxy Resin, Polyester Resin, Chrome lignin, and the like; and, wherein said leaching fluid is selected from the following:

Nitric acid and
Sulfuric acid.

6. The method of claim 1 wherein the leaching steps are carried out according to the following additional steps:

(5) homogenizing a mixture of acid aqueous solution and an organic extractant solution so that after the mixture has been pumped downhole into contact with said ore body, the acid aqueous solution leaches the uranium from the ore and the spent acid aqueous solution separates from the organic solution and migrates to the bottom of the ore body while the organic solution migrates towards the top of the ore body, and the uranium ion is transferred from the aqueous acid solution into the organic solution;

(6) producing the organic solution from the top of the ore body.

7. The process of leaching uranium from uranium ores contained within an ore body comprising the steps of:

(1) forming a leaching solution by homogenizing a mixture comprised of an organic extractant solution admixed with an aqueous acid solution;

(2) adding the homogenized mixture to an ore body and thereafter allowing the mixture to remain in contact with said ore body until the mixture separates into spent aqueous acid solution and an organic solution with said organic solution migrating towards the top of said ore body and the spent aqueous acid solution gravitating towards the bottom of said ore body;

(3) producing the organic solution from the top of the ore body; and, (4) removing uranium values from the produced organic solution.

8. The process of claim 7 wherein said ore body is an underground formation and said mixture is added to said ore body according to the following step:

(5) drilling a borehole into said ore body and flowing said mixture downhole into contact with said ore body, and thereafter producing said organic solution by lifting the organic solution up through the borehole.

9. The method of claim 8 wherein said ore body is isolated from the surrounding strata according to the following steps:

(6) drilling boreholes about the periphery of said ore body;

(7) flowing barrier-forming substance down said boreholes;

(8) applying sufficient pressure to the flowing substance to cause the substance to flow across the strata between adjacent holes;

(9) carrying out step 2 after an impervious barrier has been formed about said ore body.

10. The method of claim 9 and further including the step of forming said drill holes such that the drill holes extend across the top and across the bottom of said ore body so that the impervious barrier is in the form of a cocoon which completely incapsulates said ore body.

11. The method of claim 8 wherein said barrier-forming substance is selected from the group consisting of:

cement grouts, clay grouts, silica grouts, organic polymers, and chrome-lignin; and, said leaching fluid is selected from the group consisting of nitric acid and sulphuric acid.

12. Method for recovering metal values by insitu leaching of an ore body located below the surface of the earth, comprising the steps of:

(1) forming a plurality of boreholes about the ore body to be leached by drilling the boreholes from the surface of the earth in such a manner that the boreholes are radially spaced about said ore body;

(2) forming an impervious barrier about said ore body by pumping a barrier-forming substance downhole through said boreholes in sufficient quantity to form a continuous wall which extends circumferentially about the ore body; wherein said barrier-forming substance has the property of being a liquid when pumped and where thereafter said barrier-forming substance forms an impermeable barrier;

(3) flowing leaching fluid downhole into intimate contact with said ore body where said leaching fluid is contained in intimate contact with said ore body by said barrier;

(4) recovering the pregnant leaching fluid after the mineral values have been gained from the ore;

(5) said leaching fluid is made by homogenizing a mixture of acid aqueous solution and an organic extractant solution so that after the mixture has been pumped downhole into contact with said ore body, the acid aqueous solution leaches the uranium from the ore and the spent acid aqueous solution separates from the organic solution and migrates to the bottom of the ore body while the organic solution migrates towards the top of the ore body, and the uranium ion is transferred from the aqueous acid solution into the organic solution;

(6) using a water drive to force the organic solution to the top of the ore body; and, (7) producing the organic solution from the top of the ore body.

13. Process for recovering mineral values from an underground formation according to the following steps:

forming a plurality of radially spaced boreholes circumferentially about the formation and extending the boreholes from the earth's surface, downhole about the formation, and then turning the lower marginal end of the boreholes laterally across the bottom of the formation;

flowing a barrier-forming substance downhole through said boreholes and applying sufficient pressure to said barrier-forming substance until said barrier-forming substance presents a continuous curtain which extends circumferentially about the formation and under the formation so as to isolate the formation to be treated;

selecting said barrier-forming substance from a material which changes from a liquid to an impervious membrane in order to provide a barrier to the flow of leaching chemical to be subsequently employed herein;

making leaching chemical by homogenizing a mixture of an organic extractant solution and aqueous acid leaching solution, and pumping the homogenized mixture downhole into intimate contact with the ore body;

leaving the homogenized mixture downhole until the organic solution migrates in an upward direction while the aqueous acid solution gravitates in a downward direction, thereby causing the mineral values to be leached from the ore body and thereafter migrate into the organic solution and hence towards the top of the ore body;

producing the separated organic solution from the top of the ore body by using a water drive to force the organic solution towards the surface of the ore body where the organic solution bearing the mineral value is produced.

14. The process according to claim 13 wherein said barrier is in the form of a cup which is upwardly opening toward the surface of the ground.

15. Process for recovering mineral values from aan underground formation according to the following steps:

forming a plurality of radially spaced boreholes from the earth's surface which extend circumferentially about at least part of the formation;

flowing a barrier-forming substance downhole through said boreholes until said barrier-forming substance presents a continuous curtain which extends circumferentially about the formation to be treated;

selecting said barrier-forming substance from a material which changes from a liquid to an impervious membrane in order to provide a barrier to the flow of leaching fluid to be subsequently employed herein;

said mineral values are uranium and said leaching fluid is made by homogenizing a mixture of an organic extractant solution and aqueous acid leaching solution;

pumping said homogenized mixture of leaching fluid downhole into the isolated formation after the barrier-forming substance has changed to an impervious membrane, said leaching fluid having chemical properties which cause said mineral value to enter into solution therewith;

leaving the homogenized mixture downhole until the organic solution migrates in an upward direction while the aqueous acid solution gravitates in a downward direction, thereby causing the uranium ions to be leached from the ore body and thereafter migrate into the organic solution and hence towards the top of the ore body;

producing the separated organic solution from the top of the ore body;

and further including the step of using a water drive to force the organic solution towards the surface of the ore body where the organic solution bearing the mineral value is produced.

* * * * *